United States Patent [19]

Johnston

[11] 4,164,930

[45] Aug. 21, 1979

[54] COOKING STOVE

[76] Inventor: Harold E. Johnston, 8039 43rd Ave. NE., Seattle, Wash. 98115

[21] Appl. No.: 789,940

[22] Filed: Apr. 22, 1977

Related U.S. Application Data

[63] Continuation-in-part of Ser. No. 740,965, Nov. 11, 1976, abandoned.

[51] Int. Cl.[2] ..... F24C 5/20

[52] U.S. Cl. ..... 126/38; 126/43

[58] Field of Search ..... 126/38, 43, 44; 431/344

[56] References Cited

U.S. PATENT DOCUMENTS

| | | | |
|---|---|---|---|
| 695,979 | 3/1902 | Widmer | 126/43 X |
| 2,154,305 | 4/1939 | Goerl | 126/38 |
| 2,502,434 | 4/1950 | Creitz | 126/43 X |
| 2,530,721 | 11/1950 | Perlman | 126/43 |
| 3,371,659 | 3/1968 | Paspalas | 126/43 |
| 3,494,349 | 2/1970 | Allen | 126/25 B |

FOREIGN PATENT DOCUMENTS

| | | | |
|---|---|---|---|
| 7943 | of 1906 | United Kingdom | 126/38 |
| 311160 | 5/1929 | United Kingdom | 126/43 |

*Primary Examiner*—Edward G. Favors

*Attorney, Agent, or Firm*—Seed, Berry, Vernon & Baynham

[57] ABSTRACT

A compact cooking stove including a combustion area partially surrounded by a wind screen having a side opening which faces the wind to direct air to the burning fuel. An exhaust opening is formed adjacent a cooking pan placed at the top of the wind screen so that hot exhaust gases from the burning fuel pass upwardly toward the pan. In a first embodiment heat is supplied by a generally cylindrical burner plate including a recessed, central portion forming an alcohol fuel dish surrounded by a fairly broad rim. A plurality of pot-supporting tabs project upwardly from circumferentially spaced points about the rim to support a cooking pan above the fuel dish and rim. Heat from the burning fuel imparted to the bottom of the pan is radiated to the rim of the burner plate to heat the fuel in the fuel dish in order to promote vaporization of the fuel which increases the heat generated by the stove. A cooking pan is supported on several legs projecting upwardly from the top edge of the wind screen to form exhaust openings beneath the pan. When the stove of either embodiment is being transported, the rim of the cooking pan locks together with the rim of a cup to form a waterproof enclosure in which the stove components are stored. The stove is carried by inserting the belt of an individual through a pair of loops formed along the bottom of the cup.

14 Claims, 7 Drawing Figures

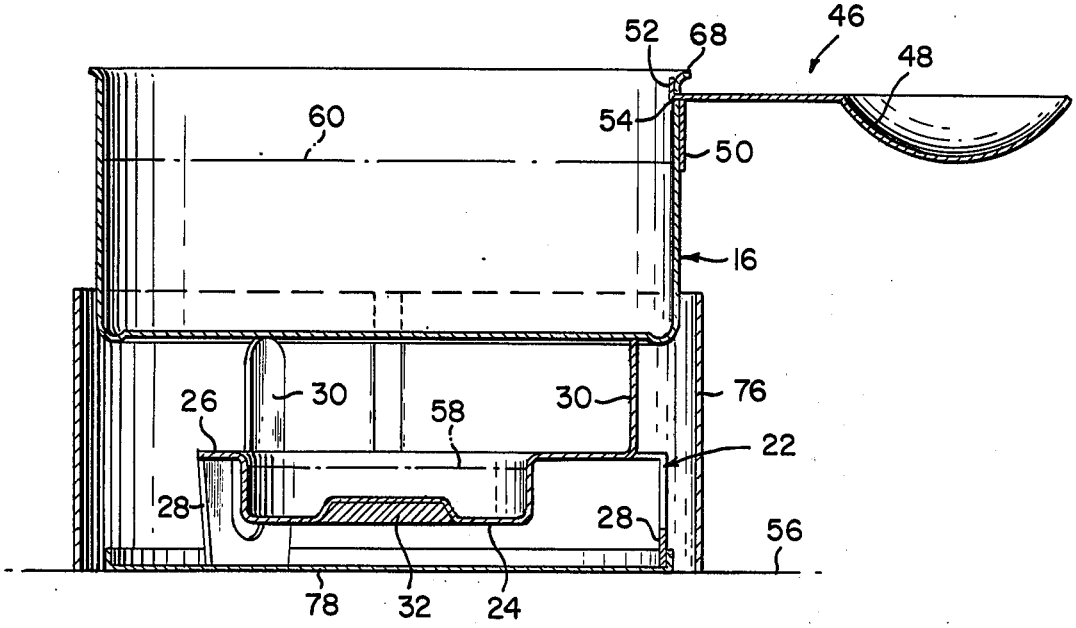
FIG. 3
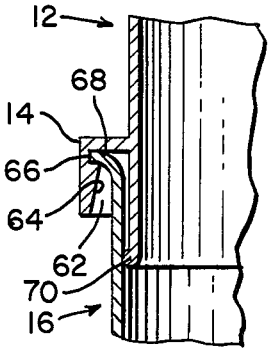
FIG. 4
FIG. 5
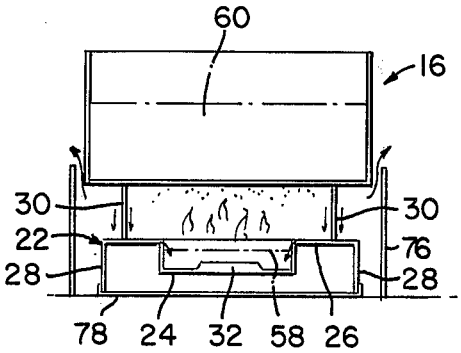

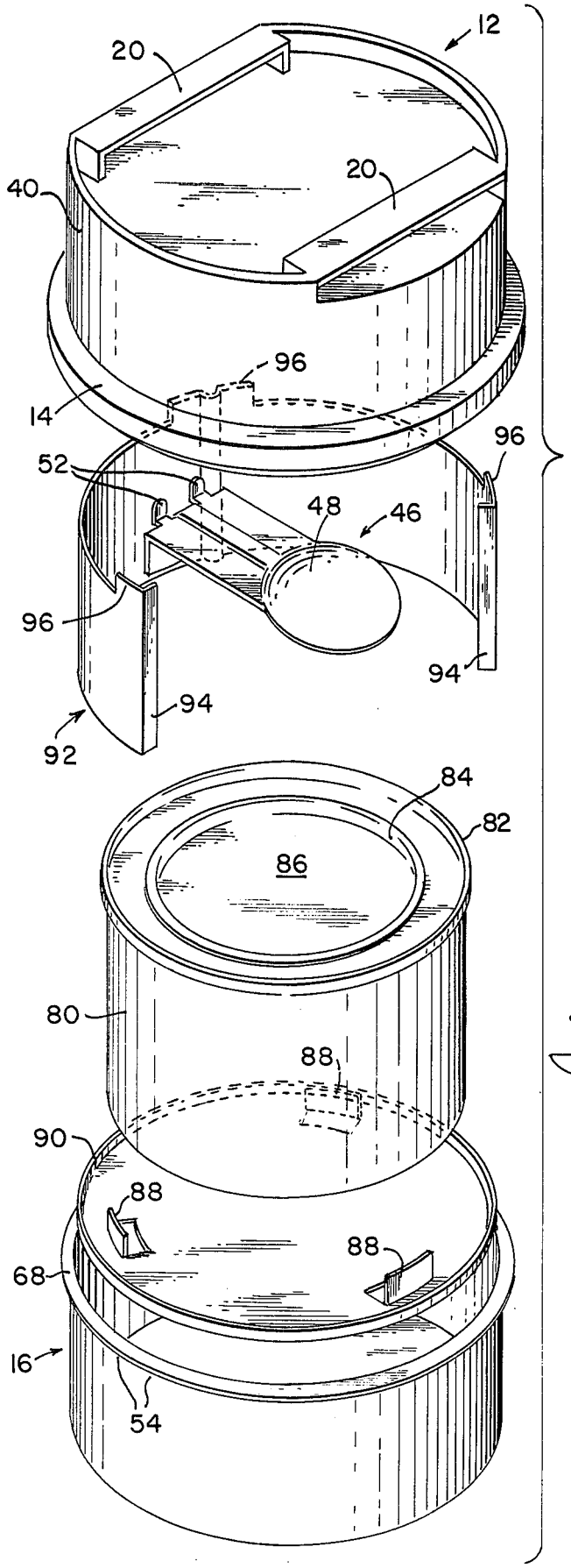
FIG. 6
FIG. 7
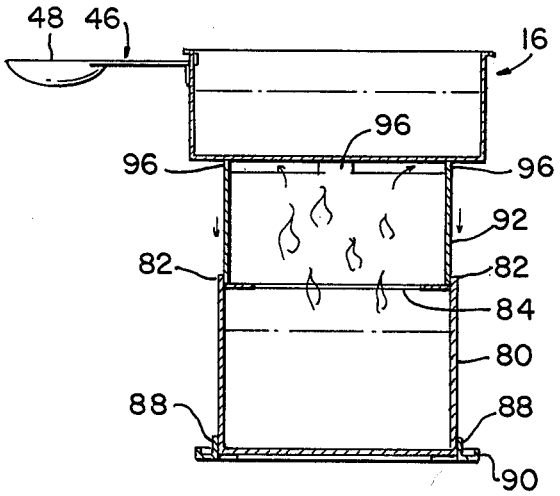

COOKING STOVE

CROSS REFERENCE TO RELATED APPLICATIONS

This application is a continuation-in-part of application Ser. No. 740,965 filed Nov. 11, 1976 abandoned.

BACKGROUND OF THE INVENTION

1. Field of the Invention

This invention relates to cooking stoves and, more particularly, to a compact stove capable of generating intense heat under adverse weather conditions.

2. Description of the Prior Art

Cooking stoves which utilize a liquid fuel have long been used for camping. With the increasing popularity of a type of camping known as "backpacking" in which all of the fuel and equipment of the camper must be carried by the camper there has developed a need for a lightweight stove which does not unduly increase the weight of the camper's load and which is compact in order to conserve the relatively small volume of space in a backpacker's pack. A compact, lightweight, self-contained stove and cooking gear unit is also a necessary component of an emergency survival kit carried by hikers, hunters, snowmobilists, boaters and pilots. One of the most critical requirements for wilderness survival is the retention of body heat since hypothermia, the excessive loss of body heat, is by far the biggest killer of people who are lost or injured in the wilderness. In order to quickly supply heat to an individual, it is necessary that the survival stove be easily and quickly operable. This is particularly true where the individual is already suffering from hypothermia since an early sympton of hypothermia is a marked reduction in mental powers and manual dexterity. Many conventional stoves which are compact and light in weight must be primed before they are operational. Yet hypothermia victims may be unable to perform the somewhat complicated and time consuming priming procedure with sufficient speed to arrest advancing hypothermia.

An additional problem encountered with many compact, liquid-fuel stoves is their relatively low heat output. In colder climates and in glacier and snow camping where snow is melted to provide drinking and cooking water, many conventional stoves, particularly those that are compact, fail to develop sufficient heat to rapidly cook food, melt snow or boil water. This problem is often intensified by severe cold and high winds which often remove heat from the stove as fast as it is produced.

In order to devise a stove which meets the aforementioned criteria, the stove must be formed of a lightweight material such as aluminum or plastic, and the various portions of the stove should compactly nest together as much as possible. Conventional stoves utilize both of these techniques to some extent, but nevertheless fail to achieve a design having optimum weight and compactness since, with few exceptions, they do not utilize the components of the stove for a multitude of purposes, and the nesting capability of the components are severely limited by their structures. Furthermore, the stove should be immediately operational without first performing any complicated procedures. Finally the stove must have a relatively high heat output even under cold and windy conditions.

SUMMARY OF THE INVENTION

It is an object of the invention to provide a cooking stove which is extremely lightweight.

It is another object of the invention to provide a cooking stove which is extremely compact.

It is still another object of the invention to provide a cooking stove which includes all of the cookware and eating utensils required for fairly simple meals.

It is a further object of the invention to provide a compact, lightweight stove which is capable of generating sufficient heat to rapidly cook foods, melt snow and boil water even under adverse weather conditions.

These and other objects of the invention are provided by a cooking stove having a combustion area partially surrounded by a wind screen. The screen has a side opening which faces toward the wind to direct air to the burning fuel, and an exhaust opening adjacent the top of the wind screen which causes the hot exhaust gases to flow upwardly toward a cooking pan positioned above the wind screen. In a first embodiment a single burner plate is used as its heat-generating component. The burner plate includes a recessed fuel dish containing a liquid fuel such as alcohol and a heat-collecting surface adapted to conduct heat from the surface to the fuel dish. Heat imparted to a cooking pan positioned above the fuel dish and heat-collecting surface is radiated to the heat-collecting surface and then conducted to the fuel dish in order to promote vaporization of fuel and provide a high-heat output. The fuel dish may be centrally located in the burner plate with the heat-collecting surface being a fairly broad rim surrounding the fuel dish. The fuel dish may be supported on a surface such as a heat reflecting pad by a plurality of circumferentially spaced feet projecting downwardly along the outer periphery of the rim. A plurality of upwardly projecting tabs may be formed along the rim for supporting the pan above the fuel dish and rim so that additional heat is conducted to the rim through the tabs. During transportation and storage, the burner plate is compactly nested with a generally cylindrical fuel tank having a central recess for receiving the fuel dish with the support feet of the burner plate extending along the outer periphery of the fuel tank. The fuel tank and burner plate are enclosed by a generally cylindrical pan and cup which are releasibly locked together rim-to-rim. A cooking handle, which is releasibly secured to the pan during cooking, includes a spoon-shaped body portion to allow the handle to be used as a dining spoon. In a second embodiment of conventional cylindrical container of fuel having a top opening is utilized instead of the burner plate. The wind screen is placed on top of the container to partially surround the opening, and a cooking pan is supported by a plurality of legs projecting upwardly from the top edge of the wind screen. The cooking stoves of the first and second embodiments are light in weight, and their structures are extremely compact. Multiple utilization of stove components further reduces the size and weight of the stoves. In spite of their relatively compact size, the stoves are capable of generating an extraordinary amount of heat for rapid cooking, boiling of water and melting of snow even under adverse weather conditions.

BRIEF DESCRIPTION OF THE FIGURES OF THE DRAWING

FIG. 3 is a cross-sectional view illustrating the cooking stove of FIG. 2 in operating position.

FIG. 4 is a cross-sectional view illustrating the latching structure which secures the rims of the pan and cup to each other.

FIG. 5 is a schematic of the principle of operation of the cooking stove of the first embodiment illustrating the manner in which heat imparted to the pan is transported to the liquid fuel to promote vaporization and insure a high-heat output.

FIG. 6 is an exploded isometric view of a second embodiment of the cooking stove illustrating the manner in which the stove components are nested together for compact storage.

FIG. 7 is a side elevational view illustrating the stove of FIG. 6 in operating position.

DETAILED DESCRIPTION OF THE INVENTION

Figure 1:
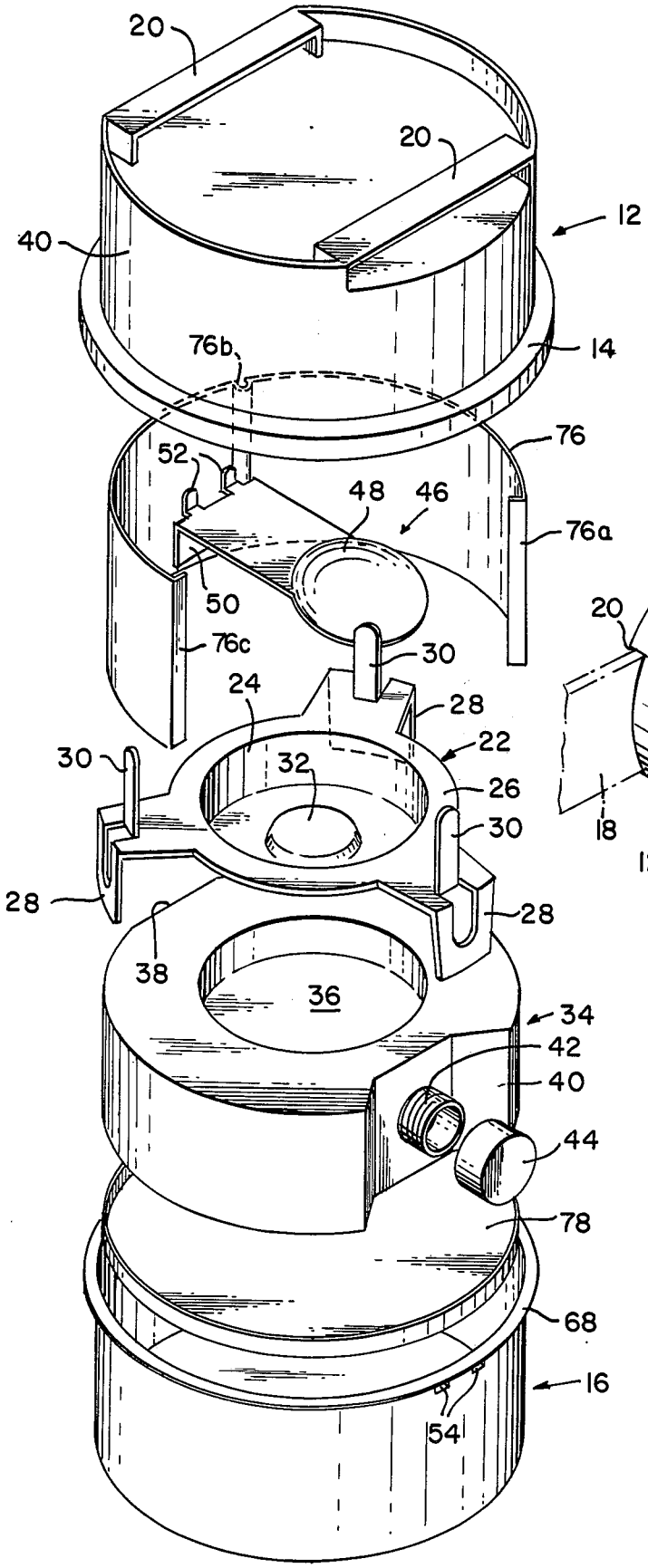
FIG. 1 is an isometric view illustrating the cooking stove in carrying position with the pans joined rim-to-rim and the cup secured to the belt of an individual.

The cooking stove of both the first and second embodiments, as illustrated in its transportation configuration in FIG. 1, includes a cylindrical cup 12 having its rim 14 interlocking with the rim (not shown) of a cooking pan 16 to form an enclosed container. A belt 18 worn by a backpacker is inserted through a pair of generally elongated loops 20 formed along the bottom of the cup 12. Thus the cooking stove, by being transported on the belt of an individual, conserves storage space in the the individual's packbag or other carrying container.

Figure 2:
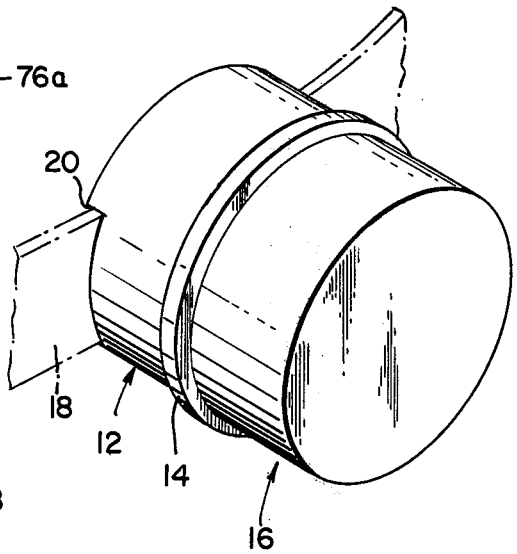
FIG. 2 is an exploded isometric view of a first embodiment of the cooking stove illustrating the manner in which the stove components are nested together for compact storage.

The components of the first embodiment of the cooking stove are shown in FIG. 2 which also illustrates the manner in which the components are nested together for compact storage. The basic component of the cooking stove is a burner plate 22 having a central recessed fuel dish 24 surrounded by a fairly broad, annular rim 26. Three circumferentially spaced support feet 28 extend radially from the rim 26 and then downwardly to support the burner plate on a horizontal surface. An elongated tab 30 projects upwardly from each of the support feet 28 to support the pan 16 above the fuel dish 24 and rim 26. The tabs 30 are preferably formed by cutting out an elongated portion of the support feet 28 and then bending them upward. As best illustrated in FIG. 3, a solid, heat-retaining disc 32 may be formed in the center of the fuel dish 24. As more fully explained hereinafter, the disc 32 retains and stabilizes heat conducted to the fuel dish 24 through the rim 26. The burner plate 22 is fabricated to a heat-conducting material which is preferably light in weight such as aluminum.

The burner plate 22 nests with a generally cylindrical fuel tank 34 having a center recessed portion 36 receiving the fuel dish 24. The support feet 28 are positioned a greater distance from the center of the fuel dish 24 than the radius of the tank 34 so that the support feet 28 extend along the outer periphery of the cylindrical fuel tank 34 to allow compact nesting. A flat portion 38 occupying a cord of the cylindrical tank 34 allows the tank 34 to stand upright on a flat surface to facilitate filling the tank 34 with liquid fuel. The tank 34 is filled and emptied through a threaded opening 42 on the opposite side of the tank 34 from the flat portion 38 which is closed by a threaded cap 44. The annular rim of the tank 34 extends beyond the opening 42 so that when the tank 34 has been filled with fuel a pair of expansion chambers 40 are produced which allow the fuel to expand responsive to a temperature increase. The shape of the tank thus prevents the expansion chambers 40 from being filled even when the tank 34 has been filled to the level of the opening 42. The tank structure also recesses the opening 42 and cap 44 to provide sufficient clearance so that the tank 34 can fit within the pan 16.

A combination handle and dining spoon 46 is also stored within the cup and pan 12,16, respectively. The handle 46 includes a spoon-shaped body portion 48 at one end and a downwardly extending flange 50 and upwardly extending tabs 52 at the other end. As best illustrated in FIG. 3, the flange 50 abuts the outer wall of the pan 16 and the tabs 52 are inserted through slots 54 along the rim of the pan 16 to releasibly secure the handle 46 to the pan 16 so that the pan 16 may be manipulated while it is hot. By virtue of the spoon-shaped body portion 48, the handle 46 is also used as a dining spoon. During transportation and storage a heat reflecting pad 78 is placed on the bottom of the pan 16, and a wind screen 76 surrounds the tank 34. The function and operation of the wind screen 76 is described in detail hereinafter.

The cooking stove of the first embodiment is illustrated in operation in FIG. 3. The support feet 28 of the burner plate 22 are placed on the heat reflecting pad 78, and a quantity of a liquid fuel 58, preferably alcohol, is placed in the fuel dish 24. The pan 16 is then placed on the top edges of the pot-supporting tabs 30, and the wind screen 76 is placed around the burner plate 22 and the combustion area between the plate 22 and the pan 16. As best illustrated in FIGS. 2, the wind screen 76 has a length substantially less then the circumference of the burner plate 22 and pan 16 so that an opening exists between the ends of the screen 76 when the screen 76 is placed around the burner plate 22 as illustrated in FIG. 3. The wind screen 76 includes three inwardly projecting tabs 76*a,b,c* which contact the outer periphery of the pan 16 and space the major portion of the wind screen 76 from the pan 16 so that a gap or exhaust opening is formed between the pan 16 and wind screen 16 along the upper edge thereof. The wind screen 76 is oriented so that the opening between the ends of the screen 76 faces toward the wind so that air is directed to the fuel burning in the combustion area beneath the pan 16. In addition to spacing the windscreen 76 from the pan 16, the tabs 76*a,b,c* also prevent air from flowing along the inside face of the wind screen 76 in a cylindrical manner. This structure substantially prevents air flowing into the combustion area above the burner plate 22 from flowing around the combustion area and then exiting since the tabs 76*a,b,c* divert the cylindrical airflow into the combustion area. Hot gases from the burning fuel then flow upwardly through the gap between the pan 16 and the wind screen 76 and along the pan 16. Thus high winds do not reduce the heat output of the stove, but instead actually produce a greater heat output since the wind causes a "blowtorch" effect. This principal is contrary to conventional stoves which entirely surround the burning fuel with a wind screen having a large number of holes or apertures placed therein to allow air to reach the fuel for combustion. However the holes on opposite sides of the wind screen allow wind to flow horizontally through the combustion area and wind screen thereby carrying heat from the stove and resulting in excessive heat loss. The inventive wind screen 76, however, allows adequate air flow to the fuel for combustion, yet directs the hot combustion gases upwardly around the pan so that the heat produced by the burning fuel is transmitted to the pan 16.

As illustrated in FIG. 5, heat generated by the burning fuel 58 warms the pan 16 and the contents 60 therein. As the temperature of the pan 16 increases, heat is conducted to the rim 26 through the pot-supporting tabs 30, and heat is radiated from the pan 16 directly to the rim 26. Heat imparted to the rim 26 increases the temperature of the fuel dish 24 and the fuel 58 contained therein to increase vaporization of the fuel 58. A solid, heat-retaining disc 32 integrally formed in the fuel dish 24 retains and stabilizes heat transferred to the fuel dish 24 from the heat-collecting rim 26. Increased vaporization of the fuel 58 increases the temperature of the pan 16 which in turn further increases vaporization of the fuel 58 until a stable temperature is reached. Air flows into the combustion area through the opening in the wind screen 76 to produce a "blowtorch" effect, and the hot combustion gases flow upwardly through the gap between the pan 16 and screen 76 and along the outside of the pan 16. The heat output of the stove is substantially greater than with conventional compact stoves by virtue of the large quantity of heat transferred from the pan 16 to the fuel 58 which insures substantial vaporization as well as the ample supply of air and efficient utilization of the heat produced by the burning fuel. Additional heat is reflected to the burner plate 22 by the reflecting pad 78 supporting the burner plate 22.

The manner in which the cup and pan 12,16 respectively, are releasibly secured together is illustrated in FIG. 4. A slot 62 is formed along the rim 14 of the cup 12 includes an inwardly inclined outer wall 64 terminating in an annular groove 66 which receives the outwardly curved rim 68 of the pan 16. An outward bulge 70 along the edge of the cup 12 biases the curved rim 68 in the groove 66. However, the cup 12, which is preferably fabricated from a flexible plastic, is sufficiently resilient so that the rim 68 is easily removed from the groove 66 and slot 62 by pulling the cup and pan 12, 16, respectively, apart.

The cooking stove of the second embodiment, as illustrated in FIG. 6, utilizes a metal container 80 of fuel which is commercially available and sold under the trademark STERNO. The container 80 has an annular rim 82 extending around its top surface and a top opening 84 covered by a cap 86 during transport or storage within the enclosure formed by locking the rim of the pan 16 with the rim of the cup 12 in the same manner as with the stove of the first embodiment. The bottom of the container 80 is placed within a plurality of tabs 88 projecting upwardly from a reflecting pad 90, and a wind screen 92 is placed around the outer periphery of the container 80. A spoon 46 is stored above the container 80.

The stove of the second embodiment is illustrated in use in FIG. 7. The fuel container 80 is placed on the reflecting pad 90 between the tabs 88, and the cover 86 is removed from the opening 84. The wind screen 92 is then placed on the top surface of the container 80 to partially surround the opening 84 and a combustion area above the opening 84 and beneath the pan 16. The side edges of the wind screen 92 each contain a tab 94 projecting inwardly toward the combustion area. The tabs 94 deflect air flowing along the inside wall of the wind screen 92 in a cylindrical manner into the combustion area. The pan 16 is supported by several feet 96 projecting upwardly from the top edge of the wind screen 90. An exhaust opening is thus formed between adjacent support feet 96 to allow hot exhaust gases to flow outwardly beneath the pan 16. Although the wind screen 92 is somewhat resilient, it is retained in position around the opening 84 by the upwardly projecting rim 82 of the container 80. During use the side opening between the tabs 94 faces into the wind thereby producing a "blowtorch" effect for providing extremely intense heat. The hot gases then flow upwardly from the combustion area through the exhaust openings between the support legs 96 beneath the pan 16.

The inventive stove thus combines a high capacity cooking stove, fuel supply, eating utensil, cooking pan, cup and storage container in one compact, lightweight, self-contained unit. The stove is easily and quickly ignited, and it efficiently produces a large quantity of heat.

I claim:

1. A liquid-fuel stove for heating the contents of a pan, comprising a heat-conductive burner plate having a recessed fuel dish adapted to contain a quantity of liquid fuel and a heat-collecting surface adjacent said fuel dish adapted to conduct heat radiated on said surface from said pan to said fuel dish such that heat from said pan vaporizes fuel in said fuel dish, said burner plate being housed within first and second cylinderical containers having their rims releasibly secured to each other to form an enclosed storage container, said first container having a rim surrounded by an annular slot having an inwardly inclined outer wall terminating in an annular groove, said second container having a rim curving outwardly such that the rim of said second container may be inserted in the slot of said first container and retained in said groove thereby releasibly locking said first and second containers to each other.

2. A liquid-fuel stove for heating the contents of a pan, comprising a heat-conductive burner plate having a recessed fuel dish adapted to contain a quantity of liquid fuel and a heat-collecting surface adjacent said fuel dish adapted to conduct heat radiated on said surface from said pan to said fuel dish such that heat from said pan vaporizes fuel in said fuel dish, said burner plate being housed within first and second cylindrical containers having their rims releasibly secured to each other to form an enclosed storage container, said stove further including a cooking handle adapted to be fastened to one of said containers, said handle having a body portion terminating at one end in a dished portion allowing said handle to be used as a dining spoon.

3. The stove of claim 2, wherein said cooking handle has a lip projecting perpendicularly from said body portion and a pair of tabs projecting away from lip, said tabs being adapted for insertion into a pair of slots formed in the circumference of said container thereby releasibly securing said handle to said container.

4. A liquid-fuel stove for heating the contents of a pan, comprising a heat-conductive burner plate having a recessed fuel dish adapted to contain a quantity of liquid fuel and a heat-collecting surface adjacent said fuel dish adapted to conduct heat radiated on said surface from said pan to said fuel dish such that heat from said pan vaporizes fuel in said fuel dish, said burner plate being housed within first and second cylindrical containers having their rims releasibly secured to each other to form an enclosed storage container with one of said containers having formed therein along its bottom a pair of aligned, generally elongated loops such that said stove may be transported by an individual by inserting a belt worn by said individual through said loops.

5. A liquid-fuel stove for heating the contents of a pan, comprising a heat-conductive burner plate having a recessed fuel dish adapted to contain a quantity of liquid fuel and a heat-collecting surface adjacent said fuel dish adapted to conduct heat radiated on said surface from said pan to said fuel dish such that heat from said pan vaporizes fuel in said fuel dish, said burner plate being housed within first and second cylindrical containers having their rims releasibly secured to each other to form an enclosed storage container, said stove further including a generally cylindrical fuel tank having an outside diameter smaller than the inside diameter of said containers such that said tank may be enclosed within said containers along with said burner plate, said fuel tank having formed therein a central recessed portion adapted to receive the fuel dish of said burner plate thereby allowing said burner plate and fuel tank to be compactly nested together.

6. The stove of claim 5, wherein said burner plate includes a plurality of circumferentially spaced support feet projecting downwardly to support said burner plate, the diameter of the circle occupied by said support feet being greater than the outside diameter of said fuel tank such that said burner plate and fuel tank can be compactly nested with the fuel dish of said burner plate inserted in the recessed portion of said fuel tank and the support feet of said burner plate surrounding said fuel tank.

7. A liquid-fuel stove for heating the contents of a pan, comprising a heat-conductive burner plate having a recessed fuel dish adapted to contain a quantity of liquid fuel and a heat-collecting surface adjacent said fuel dish adapted to conduct heat radiated on said surface from said pan to said fuel dish such that heat from said pan vaporizes fuel in said fuel dish, said burner plate being housed within first and second cylindrical containers having their rims releasibly secured to each other to form an enclosed storage container, said stove further including a generally cylindrical fuel tank having an outside diameter smaller than the inside diameter of said containers such that said tank may be enclosed within said containers along with said burner plate a flat portion lying along a cord of said tank and an opening formed along the circumferential edge of said tank opposite said flat portion such that said tank may be easily filled by supporting said tank on said flat surface with said opening facing upward.

8. The stove of claim 7, wherein said opening is recessed below the outer periphery of said tank with a portion of said tank extending above said opening when said tank is supported on said flat portion such that said tank may be filled with fuel to the level of said opening with said extending portion remaining empty to provide for expansion of said fuel.

9. A liquid-fuel stove for heating the contents of a pan, comprising a heat-conductive burner plate having a recessed fuel dish adapted to contain a quantity of liquid fuel and a heat-collecting surface adjacent said fuel dish adapted to conduct heat radiated on said surface from said pan to said fuel dish such that heat from said pan vaporizes fuel in said fuel dish, and an annular wind screen having a length less than the circumference of said burner plate such that said wind screen partially surrounds said burner plate thereby leaving an opening between adjacent ends of said screen to admit combustion air to said fuel dish, said wind screen having a radius greater than the radius of said pan thereby forming a gap between said wind screen and pan such that said opening may be pointed into wind to allow said wind to flow into said combustion area and carry hot combustion gases upwardly along said pan and a plurality of spacers extending inwardly from said wind screen to contact the outer periphery of said pan such that said spacers support said wind screen on said pan and form an upwardly directed gap between said pan and wind screen through which hot combustion gases pass to flow upwardly along the sidewalls of said pan.

10. In a stove for heating the contents of a pan, said stove having a fuel supply, a combustion area directly above said fuel supply and beneath said pan, the improvement comprising a wind screen partially surrounding said combustion area beneath said pan and forming an exhaust opening therebetween, said screen having a side opening facing windwardly to allow wind to flow into said combustion area through said side opening, and to allow hot exhaust gases to flow upwardly from said combustion area toward said pan, said wind screen further including a pair of vertical tabs projecting inwardly toward said combustion area for deflecting air flowing along the inside walls of said wind screen into said combustion area.

11. In a stove for heating the contents of a pan, said stove having a fuel supply, a combustion area directly above said fuel supply and beneath said pan, the improvement comprising a wind screen partially surrounding said combustion are beneath said pan and forming an exhaust opening therebetween, said screen having a side opening facing windwardly to allow wind to flow into said combustion are through said side opening, and to allow hot exhaust gases to flow upwardly from said combustion area toward said pan, said stove further including first and second cylindrical containers having their rims releasibly secured to each other for storing said fuel supply therein, said first container having a rim surrounded by an annular slot, said slot having an inwardly inclined outer wall terminating in an annular groove, and wherein the rim of said second container curves outwardly such that the rim of said second container may be inserted in the slot of said first container and retained in said groove thereby releasibly locking said first and second containers to each other.

12. In a stove for heating the contents of a pan, said stove having a fuel supply, a combustion area directly above said fuel supply and beneath said pan, the improvement comprising a wind screen partially surrounding said combustion area beneath said pan and forming an exhaust opening therebetween, said screen having a side opening adapted to face windward to allow wind to flow into said combustion area through said side opening, and to allow hot exhaust gases to flow upwardly from said combustion area toward said pan, said stove further including a cooking handle adapted to be fastened to said pan, said handle having a body portion terminating at one end in a dish portion allowing said handle to be used as a dining spoon.

13. The stove of claim 12 wherein said cooking handle has a lip projecting perpendicularly from said body portion in a pair of tabs projecting away from said lip, said tabs being adapted for insertion into a pair of slots formed along the circumference of said pan thereby releasibly securing said handle to said pan.

14. In a stove for heating the contents of a pan, said stove having a fuel supply, a combustion area directly above said fuel supply and beneath said pan, the improvement comprising a wind screen partially surrounding said combustion area beneath said pan and forming an exhaust opening therebetween, said screen having a side opening adapted to face windward to allow wind to flow into said combustion area through said side opening, and to allow hot exhaust gases to flow upwardly from said combustion area toward said pan, said stove further including first and second cylindrical containers having their rims releasibly secured to each other for storing said fuel supply therein one of said containers having formed in its bottom a pair of aligned, generally elongated loops such that said stove may be transported by an individual by inserting a belt worn by said individual through said loops.

* * * * *